US006509285B1

(12) United States Patent
Yeh

(10) Patent No.: US 6,509,285 B1
(45) Date of Patent: Jan. 21, 2003

(54) FABRIC FOR MOISTURE MANAGEMENT

(76) Inventor: Patrick Yeh, No. 41, Lane 328, Li Shan St, Taipei (TW)

( * ) Notice: Subject to any disclaimer, the term of this patent is extended or adjusted under 35 U.S.C. 154(b) by 0 days.

(21) Appl. No.: 09/881,171

(22) Filed: Mar. 29, 2000

Related U.S. Application Data

(63) Continuation-in-part of application No. 09/475,216, filed on Dec. 19, 1999, now abandoned, which is a continuation-in-part of application No. 08/929,278, filed on Sep. 15, 1997, now abandoned.

(51) Int. Cl.[7] ..... D01D 5/00

(52) U.S. Cl. ..... 442/195; 442/196; 442/309; 442/334; 442/336; 442/337; 442/381

(58) Field of Search ..... 442/334, 336, 442/337, 381, 309, 195, 196

(56) References Cited

U.S. PATENT DOCUMENTS 4,798,603 A * 1/1989 Meyer et al. ..... 604/378
5,200,248 A * 4/1993 Thompson et al. ..... 428/131
5,458,963 A * 10/1995 Meirowitz et al. ..... 428/913

* cited by examiner

*Primary Examiner*—Elizabeth M. Cole

(57) ABSTRACT

A fabric for moisture management which contains first fibers and second fibers. The first fibers have either circular cross-sections or multiply indentations along the longitudinal side of the fibers. The second fibers have multiply indentations along the longitudinal side of the fibers. The capillary action of the first fibers is induced by either the inter-fiber spaces alone (i.e., where the fibers have circular cross-sections) or a combination of both the inter-fiber spaces and the indentation spaces, which are formed due to indentations. The capillary action of the second fibers is induced by the combination of both the inter-fiber spaces and the indentations spaces, which are formed due to indentations. The capillary action of the second fibers is greater than that of the first fibers so that the moisture absorbed by the first fibers can be easily transferred to the second fiber.

29 Claims, 7 Drawing Sheets

FABRIC FOR MOISTURE MANAGEMENT

Related Application

This is a continuation-in-part application of U.S. patent application Ser. No. 09/475,216, filed on Dec. 19, 1999, now abandoned which is a continuation-in-part application of U.S. patent application Ser. No. 08/929,278, now abandoned filed Sep. 15, 1997.

BACKGROUND OF THE INVENTION

1. Field of the Invention

The invention relates in general to a fabric for wicking sweat or moisture, and more particularly to a fabric which wicks sweat or moisture from the skin using the difference in capillarity between two fibers composing the fabric.

2. Description of the Related Art

To facilitate absorption of the perspiration of the wearer, garments are preferably made of a textile fabric consisting of natural fiber, such as cotton, silk or linen, or by a blend of natural and synthetic fibers. Such garments, though they can absorb perspiration from the skin, cannot quickly disperse the moisture away from the skin. Once this kind of garment absorbs perspiration, a period of time is required to evaporate moisture, thus, the wearers will feel cold and clammy.

A composite textile fabric having moisture management characteristics is disclosed in an U.S. patent application Ser. No. 08/569,610 dated Aug. 12, 1995 by Patrick Yeh. This application discloses a composite textile fabric for wicking moisture away from the skin of the wearer, and transporting moisture from its skin-side surface to the opposite surface. The fabric includes a skin-side fabric layer of a relatively high denier; and an outer fabric layer which includes fibers of a relatively low denier in order to pull perspiration and other body fluids form the first fabric layer.

However, the above-mentioned textile fabric has a limitation in that the denier of the outer layer must be lower than that of the skin-side layer. Also, the ability to disperse moisture is proportional to the denier ratio of the skin-side layer to the outer layer. In other words, in order to increase the ability to disperse moisture, the denier difference between these two layers is preferably elevated. However, reducing the denier of the outer layer improves the ability to disperse moisture but worsens the wearability of the textile fabric, which is not suitable for work clothing. On the other hand, if the denier of the outer layer is increased to increase the wearability of the fabric, the denier of the skin-side layer should likewise be increased to maintain its ability to disperse moisture, which causes a rough-textured skin-side layer.

SUMMARY OF THE INVENTION

It is therefore an object of the invention to provide a fabric for moisture management without relying on the limitation of the denier ratio between layers, and with the advantages of high wearability and comfortable texture. Moreover, the denier of the outer layer can be conditionally increased to enlarge the inter-fiber space of the outer layer, which consequently increases the ventilation and the easy dry-out effect.

It is another object of the invention to provide a fabric for moisture management including a number of first fibers and a number of second fibers. The first fibers are composed fibers having no indentations along the longitudinal sides of the fibers. The cross-sections of the first fibers are generally circular in shape, although a slightly irregular shape is acceptable. The second fibers are composed of fibers having multiple indentations along the longitudinal sides of the fibers multi-lobal cross-sections. Both of the fibers and the second fibers have inter-fiber spaces, which define as the spaces formed between or among adjacent fibers. The second fibers also have indentation spaces, which are defined as the spaces which are contoured by the indentations.

The capillary action of the first fibers is determined by the inter-fiber spaces of the first fibers only. The capillary action of the second fibers is determined by both the inter-fiber spaces of the second fibers and the indentation spaces of the second fibers. The indentation spaces of the second fibers are smaller than the inter-fiber spaces of the first fibers. The capillary action of the second fibers is greater than that of the first fibers.

In addition, these two fibers are made into a fabric for dispersing moisture, with the first fibers being mainly on one surface of the fabric (i.e., the surface contacting the skin) and the second fibers being mainly on another surface of the fabric (i.e., the surface away from the skin). Consequently, the moisture absorbed by the first fibers can be easily transferred to the second fibers due to the differences in capillarity of the two fibers.

It is a further object of the invention to provide a fabric for moisture management wherein the fibers are treated with a surfactant to render them hydrophilic.

It is yet another object of the invention to provide a fabric for moisture management which is formed by synthetic fibers such as polyester, nylon and acrylic.

It is yet another object of the invention to provide a fabric for moisture management in which at least a layer of fibers contains indentations such as flutes for capillarity improvement.

It is yet another object of the invention to provide a fabric for moisture management wherein the fabric is fabricated by knitting, weaving or other non-woven method.

It is yet another object of the invention to provide a fabric for moisture management which is formed by regenerated fibers.

It is another object of the invention to provide a fabric for moisture management, including a number of first fibers and a number of second fibers, wherein both the first fibers and the second fibers are composed of fibers having multiple indentations. The indentation spaces of the second fibers are smaller than the indentation space of the first fibers. The indentation space of the second fibers is also smaller than the inter-fiber space of the first fiber. The capillary action induced by the second fibers is therefore greater than that of the first fibers.

These two fibers are made into the fabric for dispersing moisture, with the first fibers being mainly on one surface of the fabric (i.e., the surface contacting the skin), and the second fibers being mainly on another surface of the fabric (i.e., the surface away from the skin). Consequently, the moisture absorbed by the first fibers can be easily transferred to the second fibers due to the difference of the capillarity.

BRIEF DESCRIPTION OF THE DRAWINGS

Other objects, features, and advantages of the invention will become apparent from the following detailed description of the preferred but non-limiting embodiments. The description is made with reference to the accompanying drawing in which.

DESCRIPTION OF THE PREFERRED EMBODIMENTS

Figure 1A:
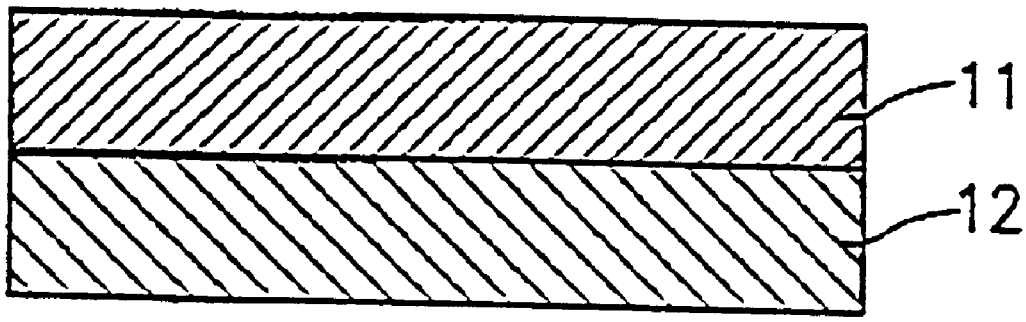
FIGS. 1*a* to 1*c* are schematic cross-sectional views of the fabrics according to the present invention.

The moisture dispersing material according to the present invention is mainly composed of two fibers (i.e., the first fibers and the second fibers). The fibers can be made of synthetic fibers, regenerated fibers or a mixture of the two. The ingredients of the synthetic fibers are one or more than one of the elements selected from the group consisting of polyester, nylon or acrylic. Both the first and the second fibers can be treated by a surfactant to render them hydrophilic. Referring to FIG. 1*a*, the two-layer structure in FIG. 1*a* only illustrates the skin-side layer of fabric and the outer layer of fabric, but not the complete structure of the fabric of the invention. The first layer 11, which is also described as the inner layer (the surface contacting the skin), includes fibers of less capillarity. The second layer 12, which is opposite to the first layer and known as the outer layer (the surface not contacting the skin), includes fibers of greater capillarity. Therefore, the perspiration in the skin can be first absorbed by the first layer 11 and then transferred to the second layer 12 due to greater capillarity.

Figure 1B:
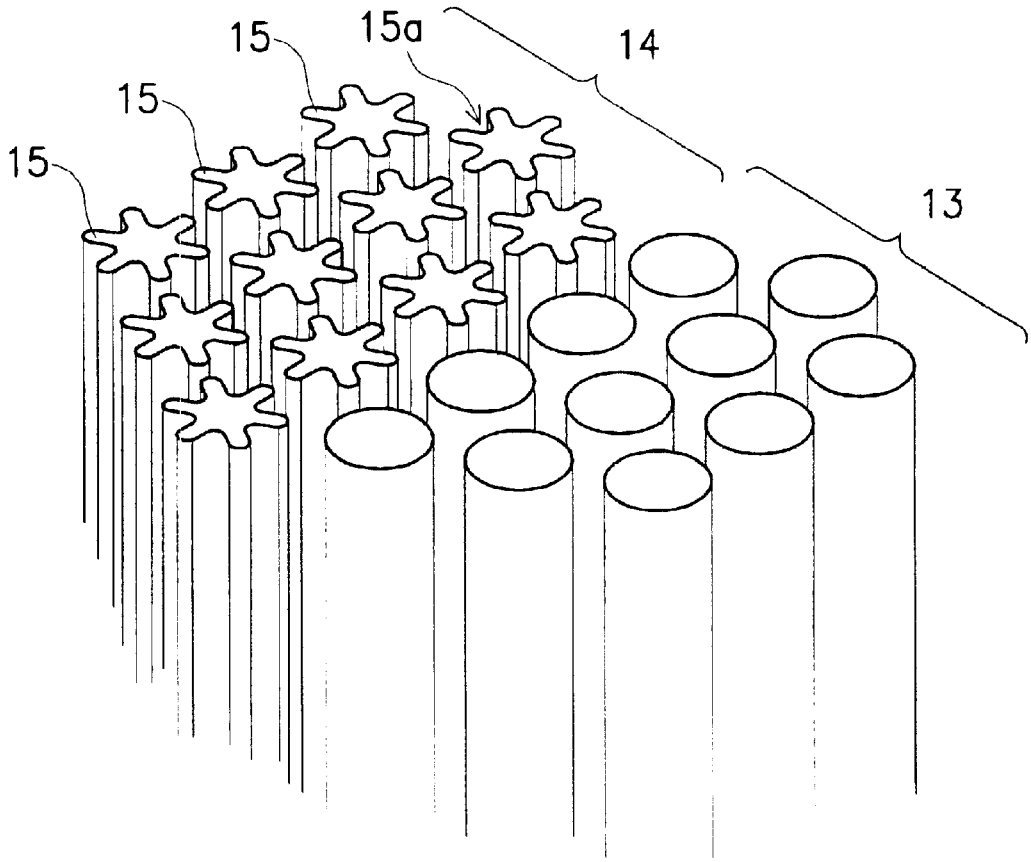

The first preferred embodiment of the present invention, as shown in FIG. 1*b*, refers to a fabric for dispersing moisture which contains a number of first fibers 13, and a number of second fibers 14. The first fibers 13 are composed of smooth fibers which are generally circular cross-sections, although occasionally somewhat irregular shaped cross-sections are acceptable. The capillarity of the first fibers is induced solely by inter-fiber spaces, which are defined as spaces formed between and among adjacent fibers. The second fibers 14 are composed of fibers mostly having indentations 15 along the longitudinal sides of the fibers. Although the second fibers also have inter-fiber spaces which can be similar or different from that of the first fibers, the indentations have created indentation spaces 15*a* which improve the capillarity. Because of the indentations 15, the second fibers have generally multi-lobal cross-sections, which can be of various shapes. The indentations 15 are formed by deweighting, alkali treatment, or alkali peeling finish, or other conventional chemical or physical processes. The indentation spaces 15*a* of the second fibers 14 are smaller than the inter-fiber spaces of the first fibers 13. In addition, the capillarity of the second fibers 14 is greater than that of the first fibers 13. Therefore the moisture absorbed by the first fibers 13, can thus be transferred to the second fibers 14 due to differences in capilarity.

Figure 1C:
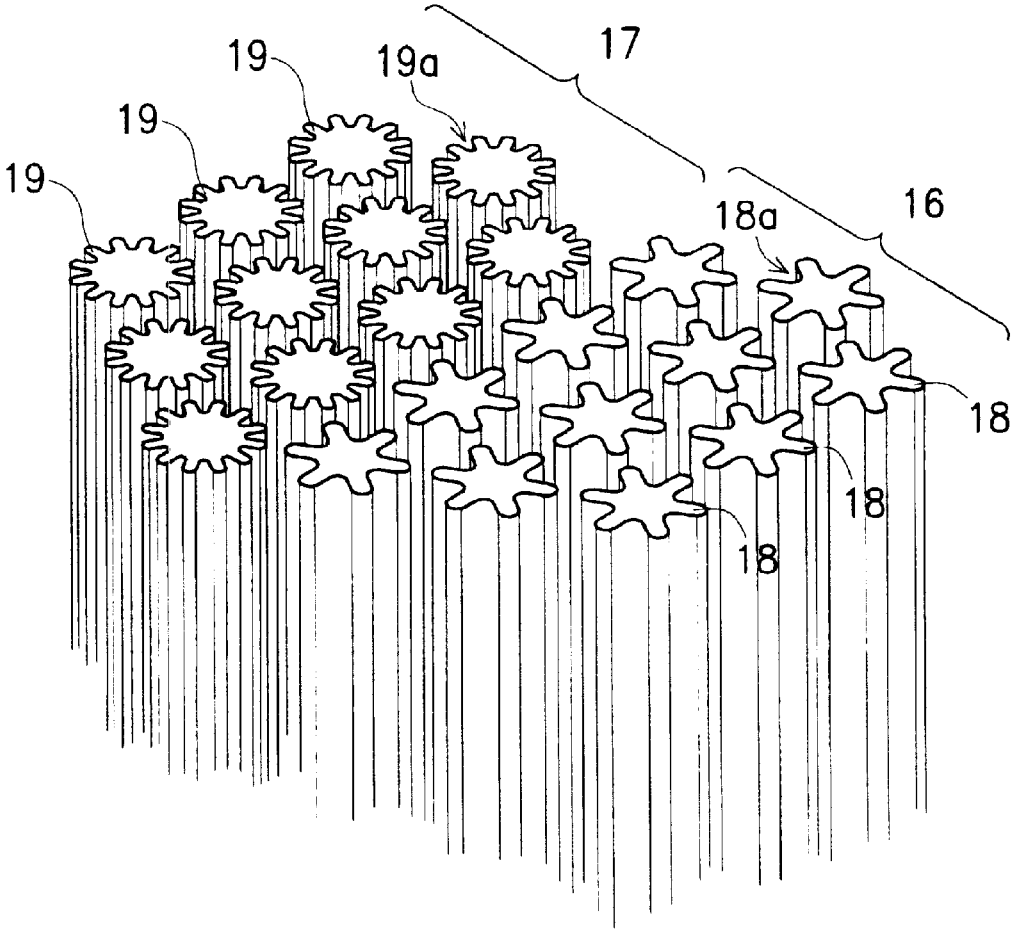

The second preferred embodiment of the present invention, as shown in FIG. 1*c*, refers to the fabric for dispersing moisture which contains a number of first fibers 16 and a number of second fibers 17. The first fibers are composed of fibers having indentations 18 along the longitudinal side of the fibers. The indentations of the first fibers substantially form multi-lobal cross-sections, preferably at least tri-lobal cross sections. The second fibers are composed of fibers having indentations 19 along the longitudinal side of the fibers. The indentations of the second fibers substantially form multi-lobal cross-sections, preferably at least tri-lobal cross sections. Both the first fibers and the second fibers have inter-fiber spaces which are similar or different. In addition, each of the indentation spaces 19*a* created by the indentations 19 of the second fibers 17 so that the capillary action of the second fibers are greater than that of the first fibers. The indentations 18 and the indentations 19 create multi-lobal cross-sections. The indentations can be formed by, for example, weight reducing treatment or other conventional processes.

The indentation spaces 19*a* of the second fibers are smaller than the indentation spaces 18*a* of the first fibers. Also, the indentation spaces of the second fibers are smaller than the inter-fiber spaces of the first fibers. Therefore, the capillarity of the second fibers 17 is greater than that of the first fibers 16. This structure can be achieved by forming the second fibers 17 with smaller fibers (i.e., fibers with smaller diameters) and/or fibers with more indentations such as flutes, goffer, pile, aperture scale or cranny, so that the moisture absorbed by the first fibers 16 can be transferred to the second fibers 17 due to the differences in capillarity.

It is therefore to be understood that the fabric for moisture management is efficient in absorbing moisture from the skin and transferring the moisture to the outer layer for dispersal, without being limited by the denier ratio between the fabric layers. The fabric of the present invention is successful in dispersing moisture simply by the capillarity differences between the two fibers, with the capillarity of the second fiber being greater than that of the first fibers. Therefore, the fabric of the present invention can be manufactured as a fabric having a higher denier outer layer and a lower denier skin-side layer, as a fabric having a lower denier outer layer and a higher denier skin-side layer, or as a fabric of two equal denier layers according to the desired application.

The fabric illustrated in FIG. 1*b* has a superb ability to disperse moisture due to the fact that the majority of the second fibers include the indentations, which form indentation spaces which in turn contribute to capillarity. Furthermore, the fabric illustrated in FIG. 1*c* has a superior ability to disperse moisture and to absorb moisture from the skin, since the first fibers (i.e., the skin-side fibers), include the indentations that contribute to capillarity.

The fabric of the present invention can be made by, for example, knitting or weaving to form a fabric having one fiber layer with indentations contributing to capillarity, or by forming another fabric having two fiber layers with indentations contributing to different levels of capillarity. Moreover, the fabric of the present invention can also be formed by other nonwoven methods such as the use of resins or ultrasound. The following section provides a further explanation of the knitting and weaving methods.

Figure 2A:
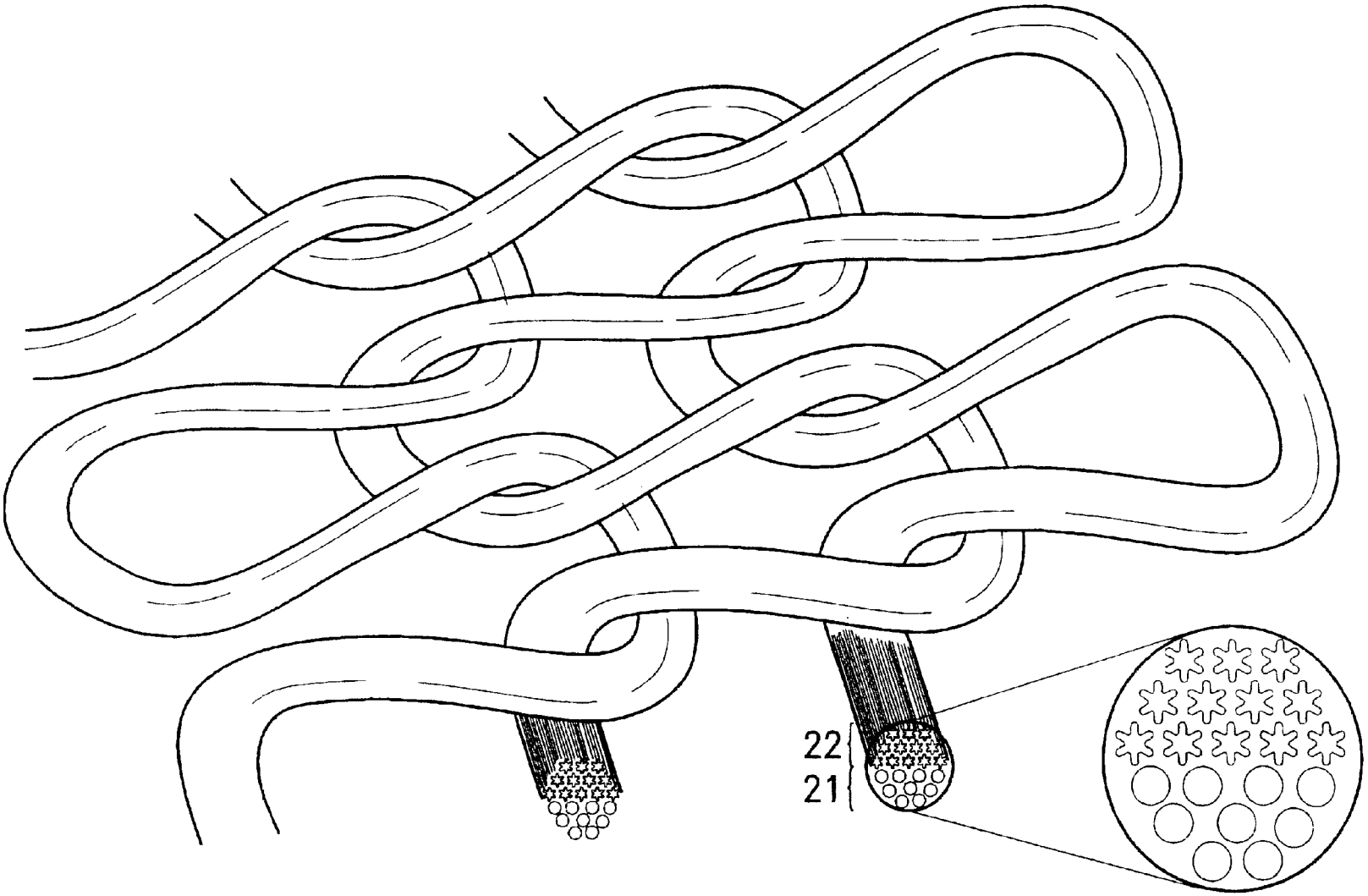
FIGS. 2*a* to 2*b* are schematic cross-sectional views of one-side of the knitted structures of the fabrics, according to the first and the second preferred embodiments of the present invention.

The third preferred embodiment of the present invention, as shown in FIG. 2*a*, provides a fabric for moisture management which is fabricated by single-side knitting, using two sets of yarns. Each set of the yarns is composed of two types of fibers, i.e., the first and the second fibers. The first fibers 21 are displayed on one surface of the fabric (the surface contacting the skin), i.e., the first surface, and the second fibers 22 are displayed on another surface of the fabric (the surface away from the skin), i.e., the second surface. The first fibers are composed of fibers which have generally circular cross-sections. The capillarity of the first fibers is induced solely by inter-fiber spaces. The second fibers 22 are composed of fibers-having multiple indentations along the longitudinal side of the fibers which contribute to the improvement of capillarity. The capillarity of the second fibers 22 is higher than the capillarity of the first fibers 21, primarily because the indentation spaces of the second fibers are smaller than the inter-fiber spaces of the first fibers. The fabric of this embodiment has a superb ability to disperse moisture.

Figure 2B:
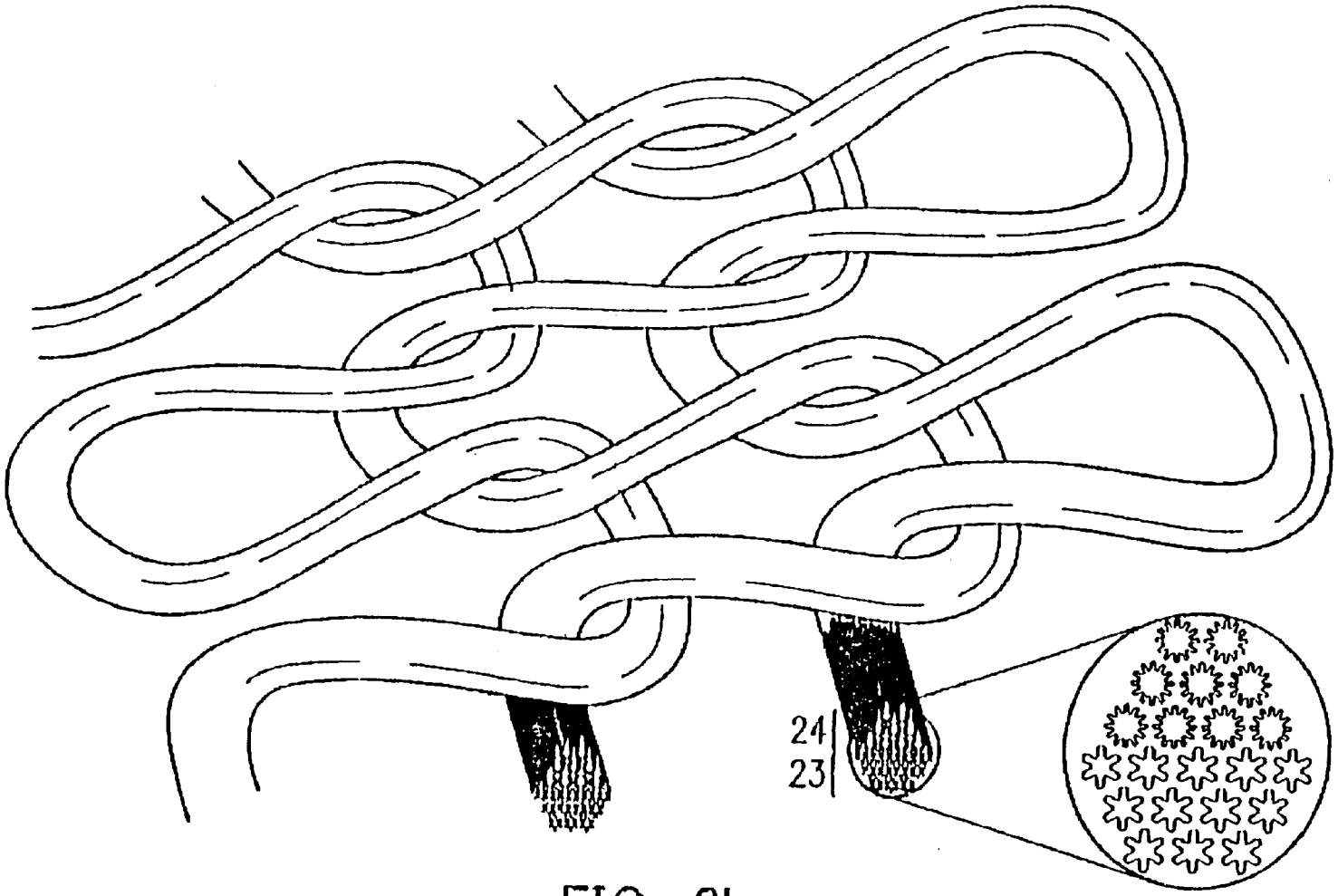

The fourth embodiment of the present invention, as shown in FIG. 2*b*, provides a fabric for moisture management which is fabricated by single-side knitting, using two sets of yarns. Each set of the yams is composed of two types of fibers, i. e., the first and the second fibers. The first fibers 23 are displayed on one surface of the fabric (i.e., the surface contacting the skin), i.e., the first surface. The second fibers 24 are displayed on another surface of the fabric (i.e., the surface away from the skin), i.e., the second surface. The first fibers 23 are composed of fibers having indentations along the longitudinal sides of the fibers. The indentations create indentation spaces which contribute to the improvement of capillarity. The indentations of the first fibers 23 substantially form multi-lobal cross-sections. Moreover, the second fibers 24 are composed fibers having indentations along the logitudinal sides of the fibers. The indentations of the second fibers 24 create indentation spaces which are smaller than the indentation spaces of the first fibers 23. The indentations of the second fibers 24 form multi-lobal cross-sections. In addition, the indentation spaces of the second fibers 24 are smaller than the inter-fiber spaces of the first fibers 23. Therefore, the capillary action of the second fibers 24 is greater than that of the first fibers 23 (that is because the smaller the indentation spaces, the greater the capillarity). Thus the fabric of this embodiment has a superior ability to disperse moisture.

Besides single-side knitting, the fabric of the present invention can also be fabricated by two-side knitting, such as two-side PK, to display the first and the second fibers on the first and second surfaces, respectively.

Figure 2C:
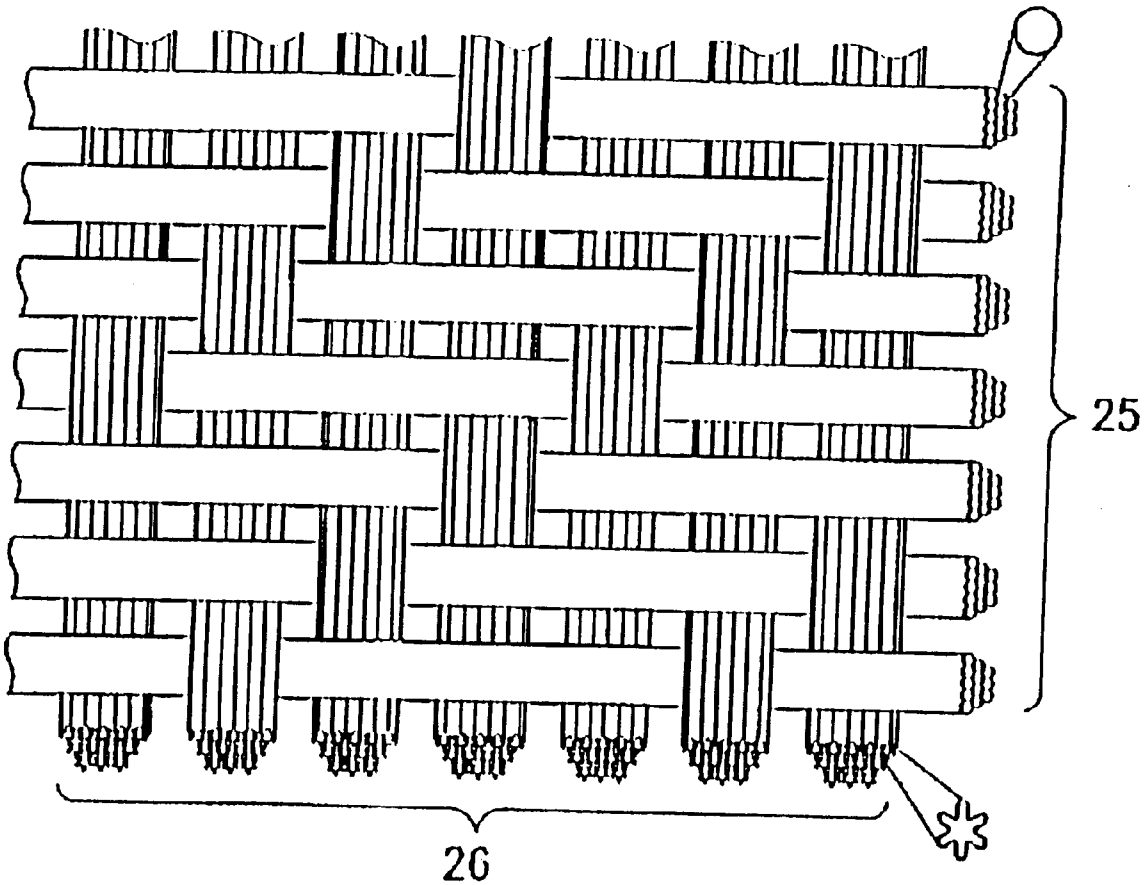
FIGS. 2*c* to 2*d* are schematic cross-sectional views of the woven structures of the fabrics, according to the third and the fourth preferred embodiments of the present invention.

The fifth embodiment of the present invention, as shown in FIG. 2*c*, provides a fabric which is fabricated by weaving. A number of the first fibers 25 are displayed on one surface of the fabric (the surface contacting the skin), i.e., the first surface. A number of the second fibers 26 are displayed on another surface of the fabric (the surface away from the skin), i.e., the second surface. The first fibers are composed of fibers having generally circular cross-sections. The capillarity of the first fibers is induced solely by inter-fiber spaces. The second fibers 26 are composed of fibers having indentations along the longitudinal sides of the fibers. The indentations create indentation spaces which improve the capillarity of the fibers. The indentation spaces of the second fibers are smaller than the inter-fiber spaces of the first fibers. Therefore, the capillarity of the second fibers is greater than the capillarity of the first fibers 25, in which the capillarity depends mainly upon the inter-fiber spaces. Thus, the fabric of this embodiment has a superb ability to disperse moisture.

Figure 2D:
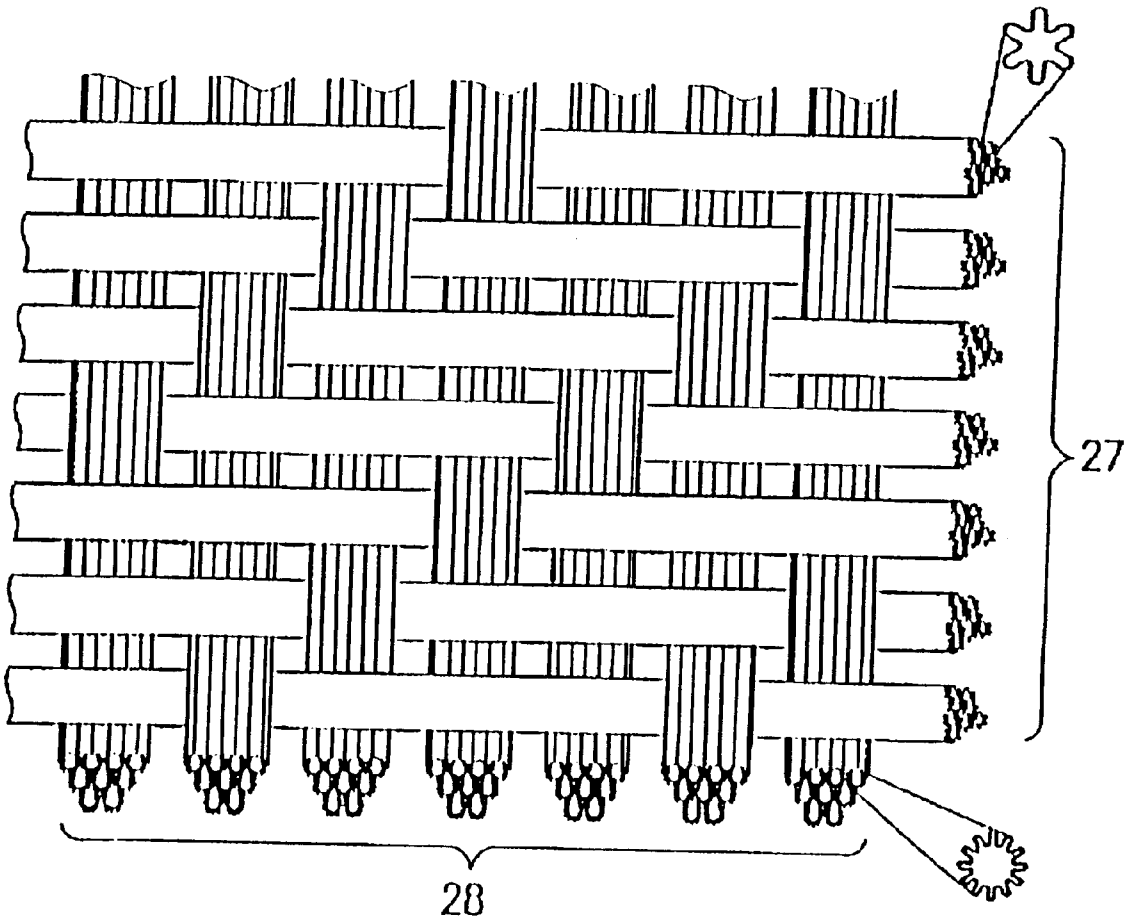

The sixth embodiment of the present invention, as shown in FIG. 2D, provides a fabric which is fabricated by weaving. A number of the first fibers 27 are displayed on one surface of the fabric (the surface contacting the skin), i.e., the first surface. A number of the second fibers 28 are displayed on another surface of the fabric (the surface away from the skin), i.e., the second surface. The first fibers 27 are composed of fibers having indentations along the longitudinal sides of the fibers. The indentations of the first fibers 27 substantially form multi-lobal cross-sections. Moreover, the second fibers 28 are composed fibers having indentations along the logitudinal sides of the fibers. The indentations of the second fibers 28 create indentation spaces which are smaller than the indentation spaces of the first fibers. The indentations of the second fibers 28 form multi-lobal cross-sections. In addition, the indentation spaces of the second fibers 28 are smaller than the inter-fiber spaces of the first fibers 27. Therefore, the capillary action of the second fibers 28 is greater than that of the first fibers 27 (that is because the smaller the indentation spaces, the greater the capillarity). Thus the fabric of this embodiment has a superior ability to disperse moisture.

Besides the above-mentioned methods, the fabric of the present invention can also be fabricated as nonwoven, or by other methods, as long as the capillarity of the outer layer is stronger than that of the skin-side layer.

Therefore, it is understood by one skilled in this art that the fabric for dispersing moisture of the present invention has the following advantages:

1. The fabric of the present invention is not limited to a certain denier ratio between the fabric layers.

2. The fibers of the outer layer need not be too thin, so that bigger spaces can be retained for ventilation, making the fabric easier to dry out.

3. The denier of the skin-side layer fibers need not to be larger than that of the outer layer fibers. Consequently, the skin-side layer fibers can be fibers with lower denier, and even smaller than the denier of the outer layer fiber, to obtain a fine and delicate fabric.

4. The outer layer fibers can be thicker fibers, so that the fabric of the present invention will have superior wearability.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fabric comprising:

a plurality of first fibers, each of said first fibers having no indentation along longitudinal sides of said first fibers; and a plurality of second fibers, each of said second fibers having a plurality of indentations along longitudinal sides of said second fibers, woven together with said first fibers in a such a manner that an inter fiber space of said first fibers is larger than an indentation space defined by the indentation of said second fibers sufficient to induce a capillary action, substantially said first fibers forms a next-to-skin layer and said second fibers forms an outer layer positioned opposite the next-to-skin layer.

2. The fabric as claimed in claim 1, wherein said indentations of second fibers form multi-lobal cross-sections.

3. The fabric as claimed in claim 1, wherein the first fibers and the second fibers are hydrophilic.

4. The fabric as claimed in claim 1, wherein the first fibers and the second fibers are synthetic fibers.

5. The fabric as claimed in claim 1, wherein the first fibers and the second fibers are regenerated fibers.

6. A fabric comprising:

a plurality of first fibers having a plurality indentations along longitudinal sides of said first fibers, said first indentations defining first indentation spaces, wherein said first indentations form at least tri-lobal cross-sections; and a plurality of second fibers each of said second fibers having a plurality of indentations along longitudinal sides of said second fibers, said indentations defining indentation spaces, said indentation spaces defined by the indentation of said first fibers is larger than said indentation spaces defined by the indentation of said second fibers to induce a capillary action, substantially said first fibers forms a next-to-skin layer and said second fibers forms an outer layer positioned opposite the next-to-skin layer.

7. The fabric as claimed in claim 6, wherein both said first indentations of said first fibers and said indentations of said second fibers form multi-lobal cross-sections.

8. The fabric as claimed in claim 6, wherein said first fibers and said second fibers are hydrophilic.

9. The fabric as claimed in claim 6, wherein said first fibers and said second fibers are synthetic fibers.

10. The fabric as claimed in claim 6, wherein said first fibers and said second fibers are regenerated fibers.

11. The fabric as claimed in claim 6, wherein said fabric is a woven fabric.

12. The fabric as claimed in claim 6, wherein said fabric is a knitted fabric.

13. The fabric as claimed in claim 6, wherein said fabric is a non-woven fabric.

14. A fabric comprising:

a plurality of first fibers, each of said first fibers having no indentation along longitudinal sides of said first fibers; and a plurality of second fibers, each of said second fibers having a plurality of indentations along longitudinal sides of said second fibers, knitted together with said first fibers in a such a manner that an inter fiber space of said first fibers is larger than an indentation space defined by the indentation of said second fibers sufficient to induce a capillary action, substantially said first fibers forms a next-to-skin layer and said second fibers forms an outer layer positioned opposite the next-to-skin layer.

15. The fabric claimed in claim 14, wherein the fibers are one kind of more than one kind of the synthetic fibers.

16. The fabric as claimed in claim 14, wherein said indentations of the second fibers form multi-lobal cross-sections.

17. The fabric as claimed in claim 14, wherein the first fibers and the second fibers are hydrophilic.

18. The fabric as claimed in claim 14, wherein the first fibers and the second fibers are synthetic fibers.

19. The fabric as claimed in claim 14, wherein the first fibers and the second fibers are regenerated fibers.

20. A fabric comprising:

a plurality of first fibers having a plurality indentations along longitudinal sides of said first fibers, said indentations defining first indentation spaces, wherein said indentations form multi-lobal cross-sections; and a plurality of second fibers each of said second fibers having a plurality of indentations along longitudinal sides of said second fibers, said indentations defining indentation spaces, woven together with said first fibers in a such a manner that inter-fiber spaces defined by said first fibers is larger than said indentation spaces defined by the indentation of said second fibers to induce a capillary action, wherein said indentations of the second fibers form multi-lobal cross-sections, substantially said first fibers forms a next-to-skin layer and said second fibers forms an outer layer positioned opposite the next-to-skin layer.

21. The fabric as claimed in claim 20, wherein the fibers are one kind of more than one kind of the synthetic fibers.

22. The fabric as claimed in claim 20, wherein the first fibers and the second fibers are hydrophilic.

23. The fabric as claimed in claim 20, wherein the first fibers and the second fibers are synthetic fibers.

24. The fabric as claimed in claim 20, wherein the first fibers and the second fibers are regenerated fibers.

25. A fabric comprising:

a plurality of first fibers having a plurality indentations along longitudinal sides of said first fibers, said indentations defining first indentation spaces, wherein said indentations form multi-lobal cross-sections; and a plurality of second fibers each of said second fibers having a plurality of indentations along longitudinal sides of said second fibers, said indentations defining indentation spaces, knitted together with said first fibers in a such a manner that inter-fiber spaces defined by said first fibers is larger than said indentation spaces defined by the indentation of said second fibers to induce a capillary action, wherein said indentations of the second fibers form multi-lobal cross-sections, substantially said first fibers forms a next-to-skin layer and said second fibers forms an outer layer positioned opposite the next-to-skin layer.

26. The fabric as claimed in claim 25, wherein the fibers are one kind of more than one kind of the synthetic fibers.

27. The fabric as claimed in claim 25, wherein the first fibers and the second fibers are hydrophilic.

28. The fabric as claimed in claim 25, wherein the first fibers and the second fibers are synthetic fibers.

29. The fabric as claimed in claim 25, wherein the first fibers and the second fibers are regenerated fibers.

* * * * *